US010619844B1

(12) United States Patent
Schiltz et al.

(10) Patent No.: US 10,619,844 B1
(45) Date of Patent: Apr. 14, 2020

(54) VENTILATION AND ILLUMINATION SYSTEM

(71) Applicant: Broan-NuTone LLC, Hartford, WI (US)

(72) Inventors: Michael Schiltz, Hartford, WI (US); Kevin Fagan, Hartford, WI (US); Richard Sinur, Hartford, WI (US); Ryan Revers, Hartford, WI (US)

(73) Assignee: Broan-NuTone LLC, Hartford, WI (US)

( * ) Notice: Subject to any disclaimer, the term of this patent is extended or adjusted under 35 U.S.C. 154(b) by 0 days.

(21) Appl. No.: 16/174,415

(22) Filed: Oct. 30, 2018

(51) Int. Cl.

| | |
|---|---|
| ***F21V 33/00*** | (2006.01) |
| ***F24F 13/08*** | (2006.01) |
| ***F21V 7/00*** | (2006.01) |
| ***F21Y 115/10*** | (2016.01) |

(52) U.S. Cl.
CPC ..... *F21V 33/0096* (2013.01); *F21V 7/0008* (2013.01); *F24F 13/082* (2013.01); *F21Y 2115/10* (2016.08); *F24F 2221/02* (2013.01)

(58) Field of Classification Search
CPC .... F21V 33/0096; F21V 7/0008; F21V 29/00; F21V 29/002; F21V 29/02; F21V 29/20; F21V 29/40; F21V 29/50; F24F 13/082; F24F 2221/02; F21Y 2115/10
See application file for complete search history.

(56) References Cited

U.S. PATENT DOCUMENTS

| | | | | |
|---|---|---|---|---|
| 3,560,729 | A | 2/1971 | Liberman | |
| 5,909,534 | A * | 6/1999 | Ko | F24H 3/0411 219/220 |
| 6,739,734 | B1 | 5/2004 | Hulgan | |
| 6,789,914 | B1 | 9/2004 | Brown et al. | |
| 7,175,309 | B2 | 2/2007 | Craw et al. | |
| 7,455,432 | B2 | 11/2008 | Craw et al. | |
| 7,874,697 | B2 | 1/2011 | Bibel et al. | |
| 8,434,916 | B2 | 5/2013 | Craw et al. | |
| 9,022,622 | B2 | 5/2015 | Craw et al. | |
| 2008/0278943 | A1 | 11/2008 | Van Der Poel | |
| 2010/0182782 | A1 | 7/2010 | Ladewig | |
| 2012/0002411 | A1 | 1/2012 | Ladewig | |
| 2012/0051041 | A1 | 3/2012 | Edmond et al. | |
| 2012/0140461 | A1 | 6/2012 | Pickard | |
| 2012/0212956 | A1 | 8/2012 | Chen | |
| 2014/0268715 | A1 | 9/2014 | Boyer et al. | |

OTHER PUBLICATIONS

Acuity Brands, Inc., Lithonia Lighting, Ordering Guide, 2010-2015, 2 pages.

(Continued)

*Primary Examiner* — Joseph L Williams
*Assistant Examiner* — Jose M Diaz
(74) *Attorney, Agent, or Firm* — Barnes & Thornburg LLP

(57) ABSTRACT

A grille assembly for a ventilation system, the grille comprising a first primary reflector, a second primary reflector configured and arranged to define an intake gap between the first primary reflector and the second primary reflector, and a secondary reflector located over the intake gap to conceal the intake gap from view; a light source on one of the first and second primary reflectors and configured and arranged to generate light wherein at least some of the light will be redirected by both the primary and secondary reflectors.

20 Claims, 10 Drawing Sheets

(56) References Cited

OTHER PUBLICATIONS

LSI Industries Inc., ASC High Efficiency, Expansive Cavity Recessed Lighting, Ordering Guide 2010, 2 pages.
Focal Point LLC, Luna 2×2 LED, Ordering Guide, Aug. 2018, 3 pages.
LSI Industries Inc., Crossover LED Lighting Technology, LED Peak Recessed Direct/Indirect (PEC), Ordering Guide, 2012, 1 page.
LSI Industries Inc., LPASC LED Low Profile Recessed Troffer, Information Sheet, 1 page.
Philips, Day Brite FluxGrid LED 2×4, Ordering Guide, 5 pages, 2016.
LSI Industries Inc., Peak Efficiency 1×4, 2×4,—Recessed Direct/Indirect, Ordering Guide, 2011, 2 pages.
LSI Industries Inc., Peak Efficiency 2×2,—Recessed Direct/Indirect, Ordering Guide, 2011, 2 pages.
LSI Industries Inc., Surface Peak Efficiency 2×2, Ordering Guide, 2012, 2 pages.
LSI Industries Inc., Surface Peak Efficiency 1×4, 2×4, Direct/Indirect, Ordering Guide, 2012, 2 pages.
LSI Industries Inc., Recessed Direct/Indirect—Side Distribution 1×4, 2×4, Ordering Guide, 2012, 2 pages.
LSI Industries Inc., Recessed Direct/Indirect—Side Distribution 2×2, Ordering Guide, 2012, 2 pages.

* cited by examiner

VENTILATION AND ILLUMINATION SYSTEM

BACKGROUND

Field

The present disclosure relates generally to devices for providing both ventilation and illumination. Devices of the present disclosure have been found particularly useful when implemented using one or more reflectors of a reflector system as an intake grille for a ventilation system. More particularly, devices of the present disclosure have been found useful when the reflector system is implemented as a troffer in which a reflector conceals both the air intake and the light source from view.

Related Prior Art

Conventional lighting and ventilating systems can combine elements of a conventional room ventilating fan with elements of a conventional light fixture. These apparatuses can have a bulky, unaesthetic appearance, can employ a complicated design, can fail to adequately cool lighting elements, and/or can employ a design where the components of the apparatus are inefficiently arranged.

Additionally, many conventional lighting and ventilating systems provide inadequate or harsh lighting. In many conventional lighting systems, light is either uncontrolled or inadequately controlled, resulting in wasted light and energy. Some light sources provide light that is unpleasant, harsh or too intense to be viewed directly by a human eye. Some lighting systems use reflectors to direct light out a lighting fixture such the light source is not directly viewable by occupants of the structure in which the lighting fixture is installed.

Therefore, a need exists for an improved lighting and ventilating system that provides an adequate amount an distribution of light as well as an appropriate amount of ventilation in an aesthetically pleasing configuration.

The description provided in the background section should not be assumed to be prior art merely because it is mentioned in or associated with the background section. The background section may include information that describes one or more aspects of the subject technology.

SUMMARY

The present disclosure relates to a ventilating and illumination system comprising a main housing defining a main housing internal volume, a main housing inlet configured to receive air into the main housing, and a main housing outlet configured to allow the air to exit the main housing; a reflector system comprising a first primary reflector, a second primary reflector configured and arranged to define an intake gap between the first primary reflector and the second primary reflector, and a secondary reflector located over the intake gap; a light source configured and arranged to generate light wherein at least some of the light will be redirected by the reflector system; and a blower configured and arranged to generate a flow of air through the intake gap and into the main housing internal volume. The secondary reflector may be configured and arranged to conceal the light source from a direct line of sight. The secondary reflector may be configured and arranged to conceal the intake gap from a direct line of sight. Air moved by the blower may pass between the secondary reflector and at least one of the first and second primary reflectors before passing through the intake gap. Air moved by the blower may encounters the light source before passing through the intake gap. The secondary reflector may be curved convexly away from the main housing internal volume. The first primary reflector may be curved concavely toward the main housing internal volume. The reflector may be located within the internal volume of the main housing. The light source may be located on the first and primary reflector. The reflector system may further comprise a first end cap extending across a first end of the first and second primary reflectors and a second end cap extending across a second end of the first and second primary reflectors. The intake gap may extend from the first end cap to the second end cap. The light source may be a light emitting diode.

The present disclosure also relates to a grille assembly for a ventilation system, the grille comprising a first primary reflector, a second primary reflector configured and arranged to define an intake gap between the first primary reflector and the second primary reflector, and a secondary reflector located over the intake gap; a light source on one of the first and second primary reflectors and configured and arranged to generate light wherein at least some of the light will be redirected by both the primary and secondary reflectors. An end cap may extend across a first end of the first and second primary reflectors. The secondary reflector may be translucent.

Additionally, the present disclosure relates to a grille assembly for a ventilation system, the grille assembly comprising a primary reflector defining an intake gap, and a secondary reflector located over the intake gap; a light source on one of the first and second primary reflectors and configured and arranged to generate light wherein at least some of the light will be redirected by both the primary and secondary reflectors. The secondary reflector is generally circular.

Moreover, the present disclosure relates to a ventilating system is disclosed comprising a main housing defining an inlet configured to receive air into the main housing and an outlet configured to allow the air to exit the main housing; a blower in the main housing and configured and arranged to generate a flow of air through the main housing inlet and through the main housing outlet, the blower comprising a scroll defining a blower inlet configured to allow air to enter the scroll, and a blower outlet adjacent to the main housing outlet and configured to allow air to exit the scroll, a blower wheel in the scroll, wherein the blower outlet is the blower outlet consuming only a portion of the area of the main housing outlet. The main housing outlet may define a height and the blower outlet defines a height less than the height of the main housing outlet. The main housing outlet may define a width and the blower outlet defines a width consuming the substantial entirety of the width of the main housing outlet.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Figure 1A:
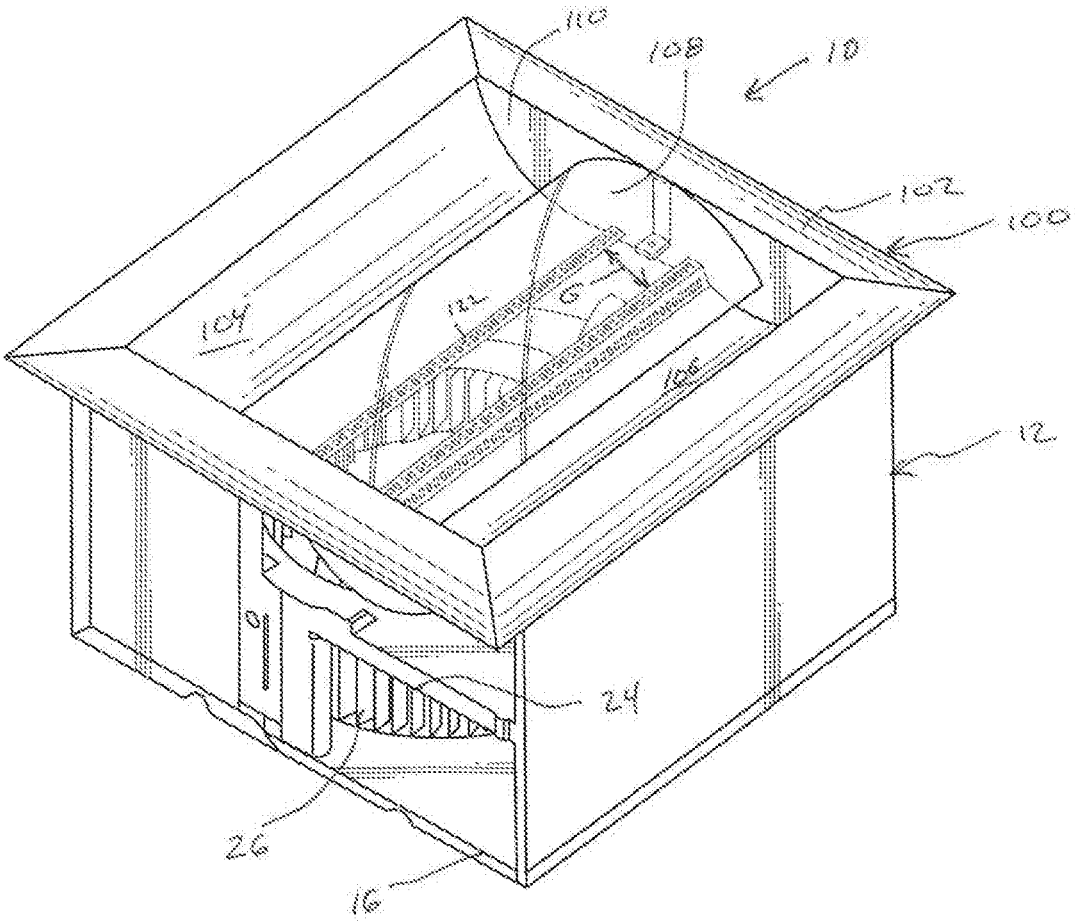
FIG. 1A is a top perspective elevation view of an exemplary embodiment of a ventilation and illumination system in accordance with the disclosure.

Referring now to the drawings, one exemplary ventilation and illumination system 10 is depicted in FIG. 1A having a main housing 12 comprised of a first side wall 12*a*, a second side wall 12*b*, a third side wall 12*c* and a fourth side wall 12*d* defining an internal volume further defined by a bottom wall 12*e* at the lower end of the first, second, third and fourth side walls 12*a*, 12*b*, 12*c*, 12*d*. The upper ends of the first, second, third and fourth side walls 12*a*, 12*b*, 12*c*, 12*d* define an inlet 14 of the main housing 12. The main housing inlet 14 could be defined in other manners and in other configurations, such as by providing a top wall (not depicted) across the first, second, third and fourth side walls 12*a*, 12*b*, 12*c*, 12*d* and defining an inlet through that top wall. In the depicted example, the main housing 12 is comprised of five walls arranged to approximate a cube, but any other number and configuration of walls and any other main housing shape is contemplated to facilitate the disclosed ventilation and illumination system 10.

The main housing 12 can comprise any material which can withstand varying temperatures while providing structural support to the system 10. In some embodiments, the main housing 12 can be formed of sheet metal. In other embodiments, the main housing 12 can be fabricated from ceramic or a polymer. The main housing 12 can be formed into any shape, including, but not limited to, a rectangular box-like shape, an oval shape, a hemispherical shape, a spherical shape, a pyramidal shape, or any other shape. The main housing 12 can form a base or a similar support structure for the system 10. In some embodiments, the main housing 12 can provide points and areas of attachment for other components of the system 10.

The system 10 includes a blower 18 operable to generate a flow of air into the main housing 12 through the main housing inlet 14 and out of the main housing 12 through a main housing outlet 16 defined in the main housing 12. The blower 18 includes a blower wheel 26 housed within a scroll 20. A motor (not depicted) to rotate the blower wheel 26 can be located within the scroll 20 or external to the scroll 20. In the depicted embodiment, the blower 18 is located within the internal volume defined by the main housing 12, but other locations are also contemplated. For example, the blower 18 could be located outside of the main housing 12 as part of a central air circulation system in which air is moved through multiple rooms, or an entire building, by one or more centrally located blowers.

The main housing outlet 16 can be defined anywhere in the main housing 12 as appropriate to direct outlet air in the desired direction. In the depicted embodiment, the main housing outlet 16 is defined in the second side wall 12*b*, but could alternatively be defined in any of a first, third and fourth side walls 12*a*, 12*c*, 12*d*, or the bottom wall 12*e*. In the depicted embodiment, the main housing outlet 16 is defined in the second side wall 12*b* in order to direct the outlet air in a direction generally perpendicular to the inlet air drawn in through the main housing inlet 14. This configuration finds useful application in a conventional ceiling installation in which the main housing inlet 14 is placed in a ceiling to draw air upward through the housing 12 and discharge the outlet air through the main housing outlet 16 generally parallel to the ceiling toward other elements of a ventilation system or to an outlet in the building structure in which the system 10 is installed. In one example, the system 10 may be installed in a ceiling of a residential bathroom between ceiling joists and an exhaust conduit could be run from the main housing outlet 16 between the ceiling joists toward an outlet vent at the exterior of the residential structure. Alternatively, the exhaust conduit could be run from the main housing outlet 16 between ceiling joists toward other portions of a larger air movement system.

Figure 2A:
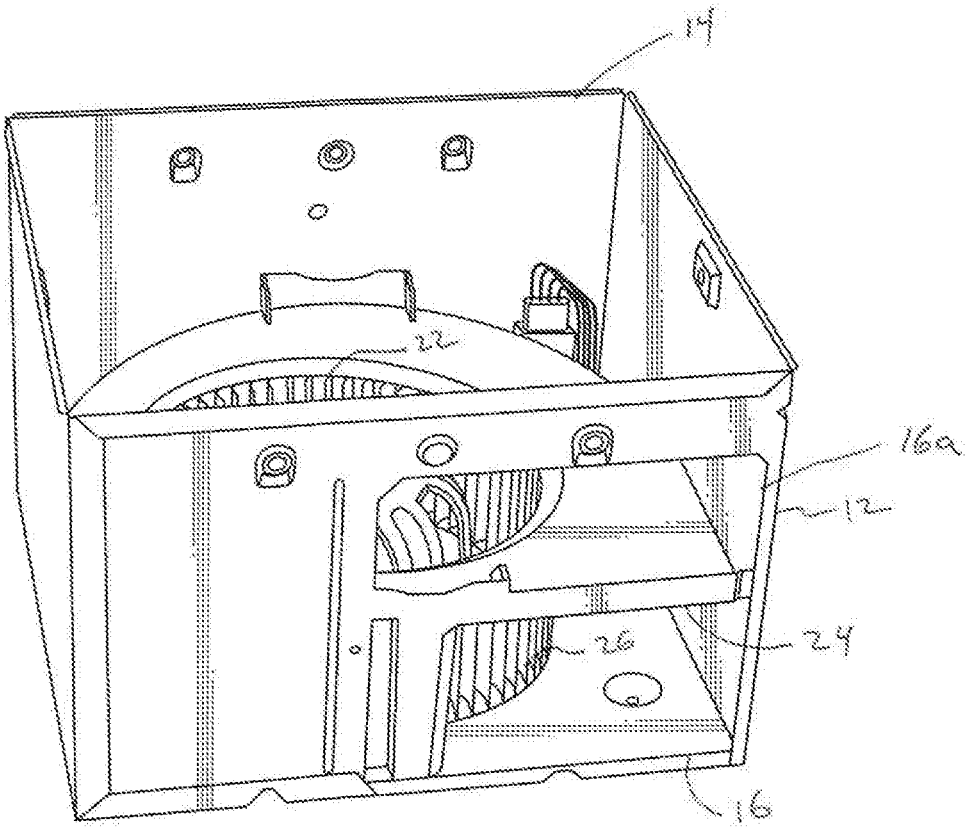
FIG. 2A is a top perspective elevational view of a main housing and blower of the ventilation and illumination system of FIG. 1A.

The blower scroll defines a blower inlet 22 (best depicted in FIG. 2A) and a blower outlet 24. The blower wheel 26 is operable to generate a flow of air into the main housing 12 through the main housing inlet 14, then into the scroll 20 through the blower inlet 22 and out of the main housing 12 through a main housing outlet 16 and blower outlet 24. The scroll may be comprised of sheet metal, ceramic, polymer or other material capable of withstanding the environment into which the system 10 is installed.

In the depicted embodiment, the blower outlet 24 is located at the main housing outlet 16 in the second side wall 12*b* of the main housing 12. However, the blower outlet 24 could be located inside the internal volume of the main housing 12 and directed out of the main housing 12 by another conduit. Alternatively, the blower outlet 24 could extend beyond the main housing 12.

Figure 1B:
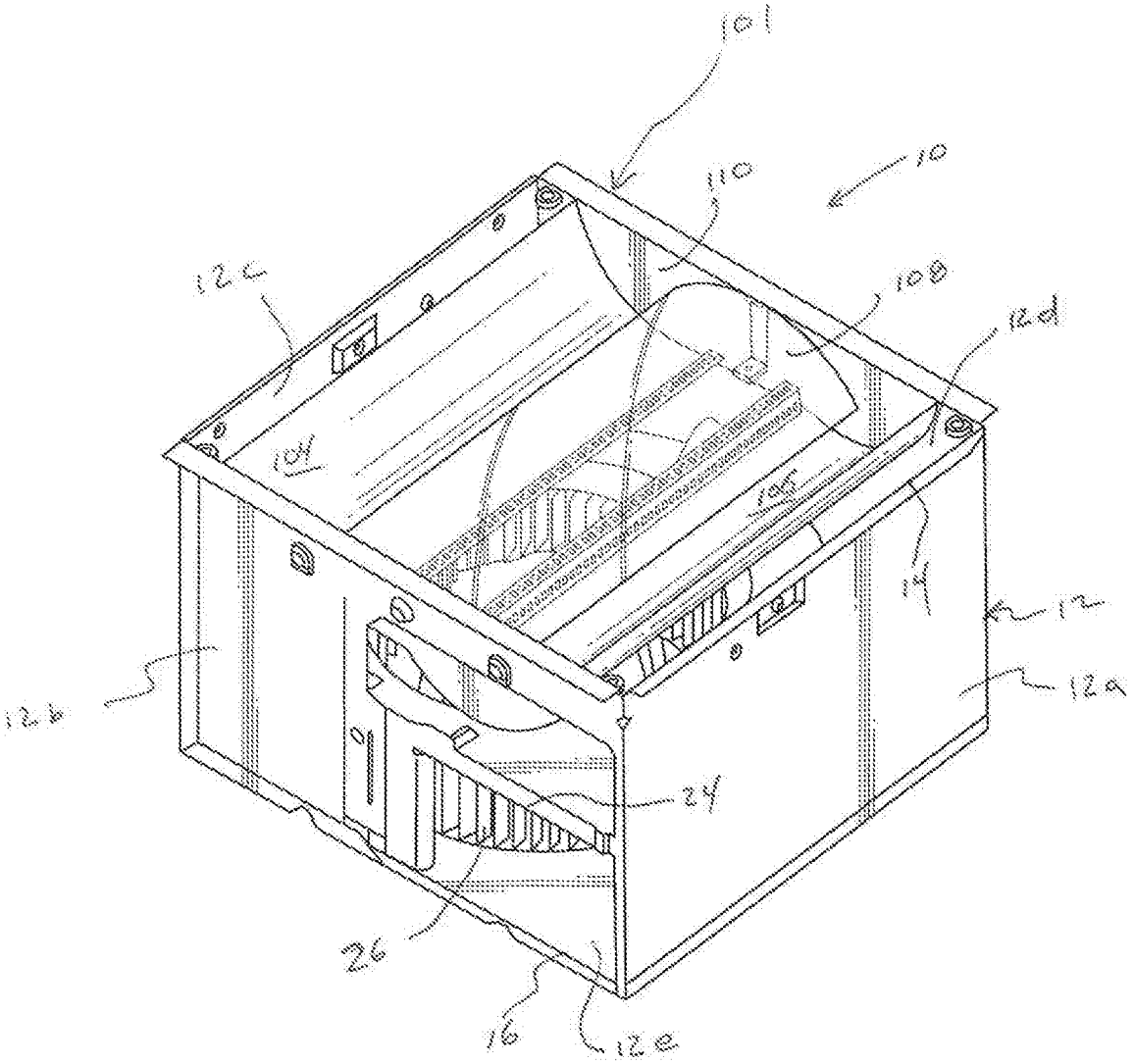
FIG. 1B is a top perspective elevation view of the ventilation and illumination system of FIG. 1A with a trim element removed from the grille to better expose the reflector system.

The blower 18 in the depicted embodiment is a low profile blower, in which the height of the blower wheel 26 and the scroll 20 is shorter than a typical blower of this application. Many ventilation fan main housings are sized to accommodate much of the available height above a ceiling in which the main housing will be installed and much of the height of those main housings can be accommodated by a blower in order to provide a greater volume of air movement with a smaller number of revolutions of the blower wheel. The main housing outlet 24 depicted, for example, in FIG. 1B is almost the entire height the main housing 12 to accommodate such a high profile blower. Installing the low profile blower 18 into a main housing 12 configured for a high profile blower results in a blower outlet 24 of a shorter height than the main housing outlet 14, leaving an outlet gap 16*a* in the housing. The outlet gap 16*a* may, optionally, be filled with a plate (not depicted) or other component. The disclosed system 10 could alternatively employ a main housing having an outlet sized to the blower outlet 24.

Using a low profile blower 18 into the main housing 12 leaves space between the blower 18 and the main housing inlet 14 which could accommodate other components. In one example, some ventilation systems typically employ housings approximately 7.5 inches high such that by using a blower with a height of 3.5 inches leaves 4 inches of height in the main housing 12 to accommodate other components.

Figure 3A:
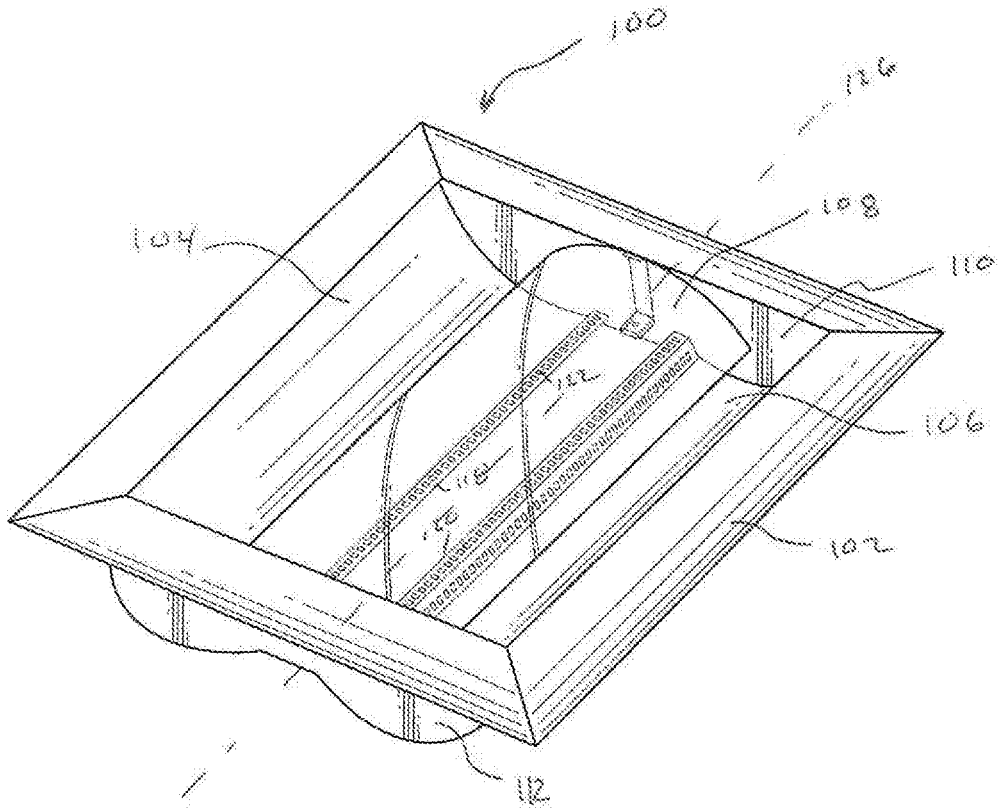
FIG. 3A is a top perspective elevational view of the grille, including the reflector system, of the ventilation and illumination system of FIG. 1A.
Figure 3B:
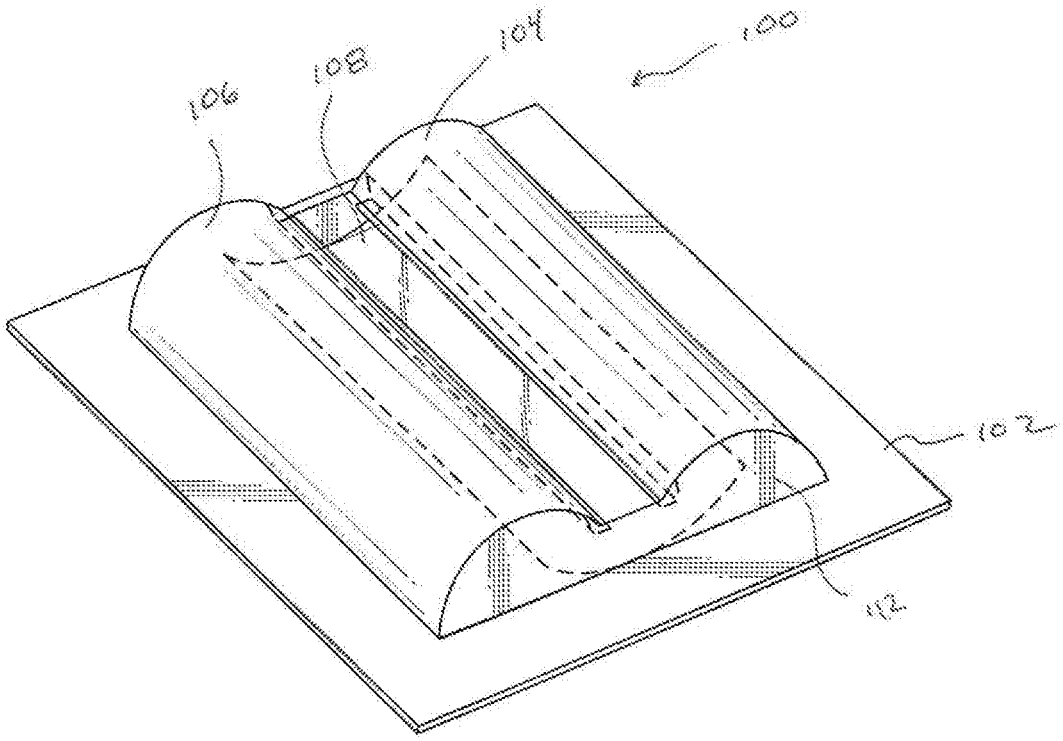
FIG. 3B is a bottom perspective elevational view of the grille, including the reflector system, of FIG. 3A.
Figure 3C:
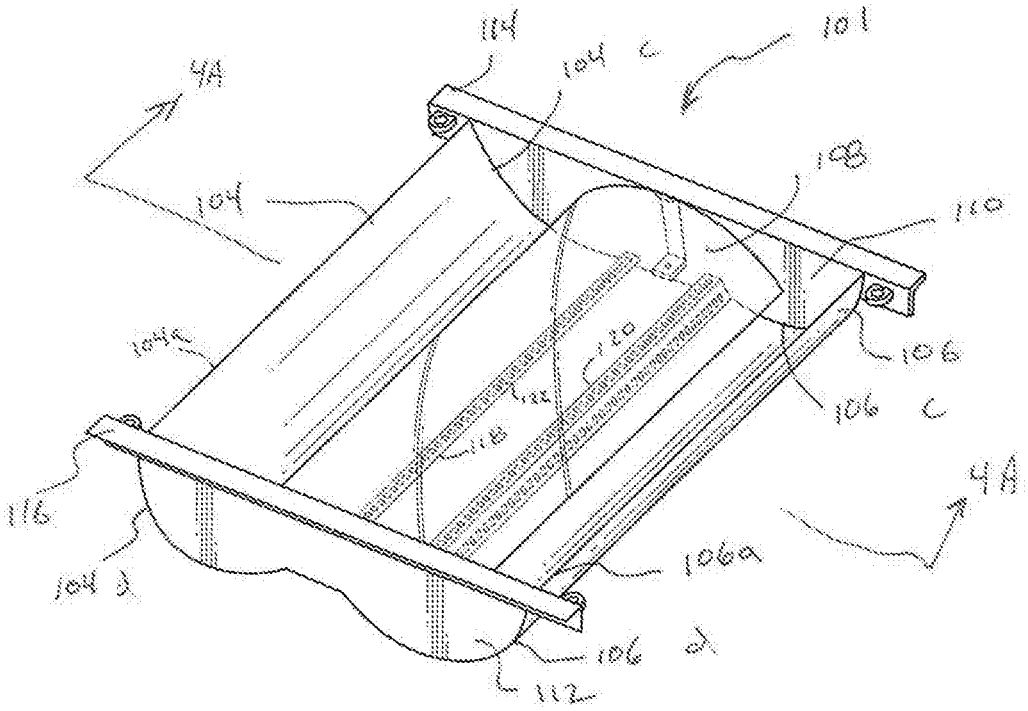
FIG. 3C is a top perspective elevational view of the reflector system of the grille of FIG. 3A.
Figure 3D:
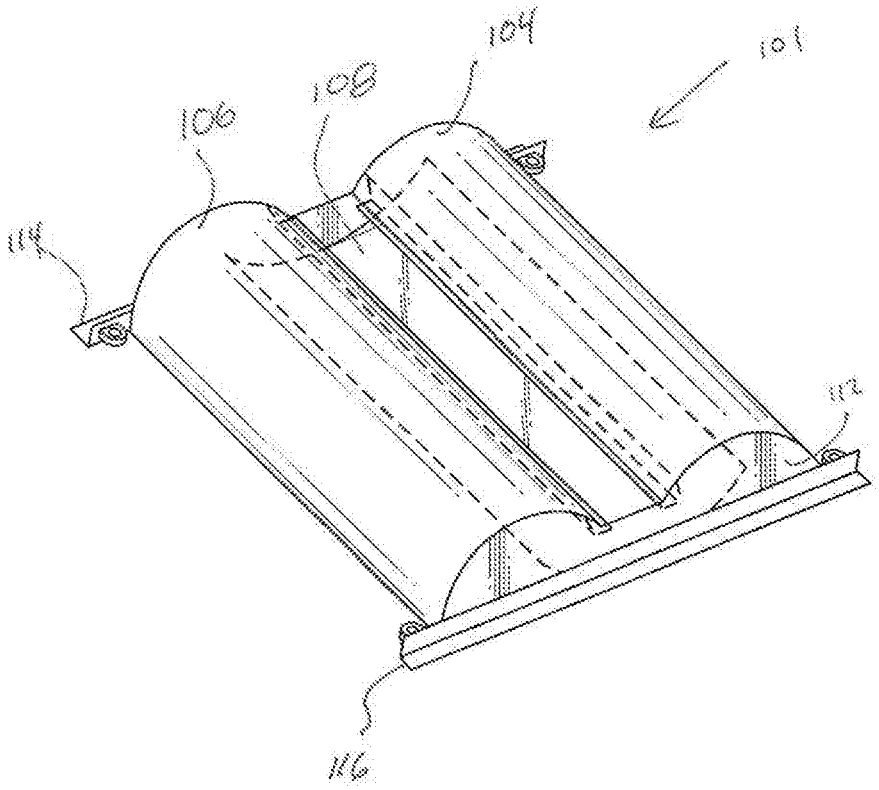
FIG. 3D is a bottom perspective elevational view of the reflector system of FIG. 3C.

FIG. 3A depicts a grille 100 comprising a reflector system 101 and an optional trim element 102 to provide an aesthetically pleasant transition between the reflector system 101 and the ceiling of a structure in which the reflector system 101 is installed. Although this disclosure discusses and depicts the grille 100 and reflector system 101 in conjunction with the main housing 12 and the blower 18, the grille 100 and/or reflector system 101 may be installed in a ventilation system in which no main housing 12 and blower 18 are nearby. For example, the grille 100 and/or reflector system 101 could be installed at the inlet or outlet of a ventilation system (e.g. fresh air system or HVAC system) having a remotely located central blower causing movement of air through the grille 100 and/or reflector system 101.

The grille 100 and/or reflector system 101 could be provided as original equipment or retrofit for a pre-existing ventilation system. For example, the grille 100 could be provided as a retrofit or replacement grill for a pre-existing ventilation system, such as a pre-existing ventilation system having a grille with no lighting component.

The reflector assembly 101 comprises a first primary reflector 104 and a second primary reflector 106. The first primary reflector 104 defines an outer edge 104*a*, which constitutes an outer edge of the reflector assembly 101, and extends from the outer edge 104*a* inward in an arcuate manner to an inner edge 104*b*. The second primary reflector 106 defines an outer edge 106*a*, which constitutes an outer edge of reflector system 101, and extends from the outer edge 106*a* inward in an arcuate manner to an inner edge 106*b*. The first primary reflector 104 extends from a first end 104*c* to a second end 104*d* and the second primary reflector 106 extends from a first end 106*c* to a second end 106*d*.

A first end cap 110 is connected to the first primary reflector first end 104*c* and the second primary reflector first end 106*c*. A second end cap 112 is connected to the first primary reflector second end 104*d* and the second primary reflector second end 106*d*. Reflector mounts 124 are located on each of the first and second end caps 110, 112 for mounting a secondary reflector 108. The first and second end caps 110, 112 can locate the first and second primary reflectors 104, 106 with respect to each other and with respect to the reflector mounts 124. Other manners are also contemplated for locating these elements with respect to each other.

A first mounting bracket 114 is connected to the first end cap 110 and a second mounting bracket 116 is connected to the second end cap 112. The first and second mounting brackets 114, 116 provide structure for securing the trim 102 to the reflector assembly 101 and may, optionally provide structure for connecting the grille to the main housing 12.

As shown throughout the figures, the depicted embodiment of the reflector assembly 101 is symmetrical about a mirror line 126 running between the first and second primary reflector inner edges 104*a*, 160*a*. As depicted, for example, in FIG. 2B, the first primary reflector outer edge 104*a* is located at the outer edge of the reflector assembly 101 and curves concavely, inward, toward the mirror line 126, but does not reach the mirror line 126. Likewise, the second primary reflector outer edge 106*a* is located at the outer edge of the reflector assembly 101 and curves concavely, inward, toward the mirror line 126, but does not reach the mirror line 126. In alternative embodiments, the reflector assembly 101 need not be symmetrical. In other alternative embodiments, one or both of the first and second primary reflectors 104, 106 could be flat.

The first and second primary reflector inner edges 104*b*, 106*b* remain separated to define an intake gap G. The intake gap G allows air to flow through the reflector assembly 101. In the depicted embodiment, portions of the intake gap G are located directly over the blower inlet 22 when the grille 100 is installed in the main housing 12. When the blower 18 is operated, air can be drawn through the intake gap G to the blower inlet 22 and out of the main housing through the blower outlet 24.

In the depicted embodiment, the intake gap G extends from the first end cap 110 to the second end cap 112 defining a constant width at all points there between to define an intake slot. However, alternative configurations of the intake gap G are contemplated so long as sufficient air may pass through the intake gap G to satisfy the ventilation requirements for which the system is designed. For example, the intake gap G could be of varying width between the end caps 110, 112 or not extend all the way from one end cap 110, 112 to the other 110, 112.

In one non-exclusive example of an alternative intake gap G, the intake gap G need not extend to both end caps 110, 112 and could instead be an aperture formed through a single primary reflector or between the first and second primary reflectors 104, 106. In one embodiment, the intake gap G could be circular. A circular intake gap G could be achieved by portions of the first and second primary reflectors 104, 106 contacting or connecting with one another. A circular intake gap G could alternatively be achieved by using a single primary reflector with a circular intake gap G formed therein. In any embodiment in which the intake gap G is an aperture not extending to the first and second end caps 110, 112, the secondary reflector 108 could be shaped to the shape of the intake gap G. For example, a circular secondary reflector 108 could be located over a circular intake gap G. In this configuration, the secondary reflector 108 could be secured to the primary reflector by a bracket.

Figure 2B:
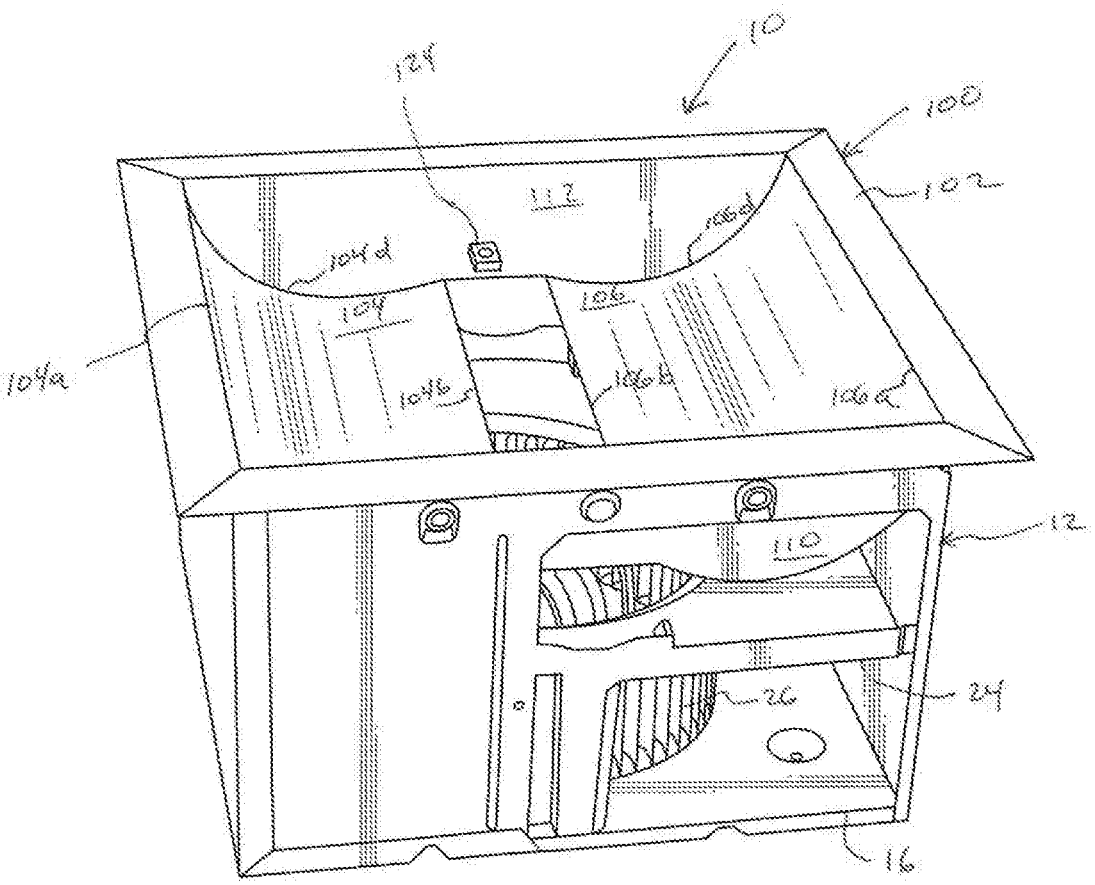
FIG. 2B is a top perspective elevational view of the main housing, blower and reflector system of the ventilation and illumination system of FIG. 1A with a secondary reflector removed.

As best depicted in FIG. 2B, the reflector system 101 is substantially entirely recessed within the internal space defined by the main housing 12. In particular, the first and second primary reflectors extend substantially into the internal space defined by the main housing 12, occupying at least some of the space created by using a low-profile fan. Similarly, the end caps 110, 112 are substantially entirely within the internal space defined by the main housing 12. In this configuration, the reflector system 101 will not protrude from a ceiling into the adjacent room of a structure after installation.

A light source 122 is located in the reflector system 101 to generate light to be cast out of the reflector system 101. In the depicted embodiments, the light sources 122 are located at or adjacent to at least one of the first and second primary reflector inner edges 104*b*, 106*b*. A first light source mount 118 extends along the length of the first primary reflector inner edge 104*b* and a second light source mount 120 extends along the length of the second primary reflector inner edge 106*b*. In the depicted embodiment, an array of light sources 122 extends along each of the first and second light source mounts 118, 120 and are operable to generate light. The figures depict two-legged first and second light source mounts 118, 120 to accommodate two light sources 122 on each light source mount 118, 120 and thereby facilitate directing light in two different directions from each light source mount 118, 120. Alternatively, or in addition, light sources 122 can be mounted directly to the first and/or second primary reflectors 104, 106 at or adjacent to the inner edges 104*b*, 106*b*.

Although the light sources 122 are depicted as evenly split between the first and second primary reflectors 104, 106, the light sources 122 can be mounted on only one of the first and second primary reflectors 104, 106 or unevenly distributed between the two primary reflectors 104, 106. In an alternative embodiment that is not depicted, the light sources 122 may be mounted to an intake side 108*c* of the secondary reflector 108, or a bracket connected to the secondary reflector 108, such that light emitted from the light sources 122 will be directed toward the primary reflectors 104, 106.

The light sources 122 can be any light source now known or later created. In one embodiment, the light sources 122 are light emitting diodes or printed circuit boards populated with one or more light emitting diodes.

In the depicted embodiment, the secondary reflector 108 is an elongated body curved convexly in a direction facing outward of the internal space of the main housing 12. The secondary reflector 108 is secured to each end cap 110, 112 by reflector mounts 124 on each. Like the primary reflectors 104, 106, the grille 100 is configured such that the secondary reflector 108 is located inside of the main housing 12 internal space when the grille 100 is secured to the housing. The secondary reflector 108 is located adjacent to the intake gap G such that the apex of its curvature is centered on the mirror line 126 and curves into the main housing 12 internal space and laterally to the secondary reflector outer edges 108*a*, 108*b*. The secondary reflector outer edges 108*a*, 108*b* extend laterally beyond the respective primary reflector inner edges 104*b*, 106*b* completely concealing the intake gap G from a direct line of sight from outside the main housing 12. In this manner, the secondary reflector 108 blocks a direct line of sight to either the light sources 122 or the intake gap G. In this configuration, all light that leaves the grille 100 reaches human eyes as indirect lighting, which provides a light that is more aesthetically pleasing to the human eye. Although the intake gap G can be more easily concealed by a secondary reflector 108 that is, as depicted, curved convexly outward, the secondary reflector 108 could be curved differently than depicted or even flat while still achieving the objectives stated herein.

In particular, light generated by the light sources 122 will reflect off one of the primary reflectors 104, 106 or the secondary reflector 108 and then one of the primary reflectors 104, 106. In some instances, light will reflect off of one or more reflectors multiple times. The specific curvatures of the primary reflectors 104, 106 and the secondary reflector 108 are optimized to provide an approximately even distribution of light to the structure in which the system 10 is intended to be installed without providing significant impediments to the fluid flow around the reflector systems 101.

The primary reflectors 104, 106 can be of any reflective material or any material capable of receiving a reflective coating. In one example, the primary reflectors 104, 106 can be made of a highly reflective sheet metal. In another example, the primary reflectors 104, 106 can be made of sheet metal or polymer with a highly reflective paint. Other examples of materials and coatings are contemplated.

The secondary reflector 108 can be made of the same material and/or coating as the primary reflectors 104, 106 or of a different material and/or coating. In one example, the secondary reflector 108 can be comprised of a material that will transmit some or all of the light that contacts its intake surface 108*c*. In this configuration, some light contacting the secondary reflector 108 will transmit through the secondary reflector 108 while some may reflect off of the secondary reflector. Some exemplary materials for a partially transmissive configuration of the secondary reflector 108 include polycarbonate, acrylic, frosted glass, perforated metal, polyethylene or the like. In this partially transmissive configuration, the secondary reflector 108 will be referenced herein as a "reflector" despite the fact that it reflects as well as transmits. Furthermore, the terms "primary" and "secondary" when used to identify the primary reflectors 104, 106 and the secondary reflector 108, impart no meaning to the purpose or functionality of those reflectors and are meant only to provide labels to distinguish the reflectors from each other.

Figure 4A:
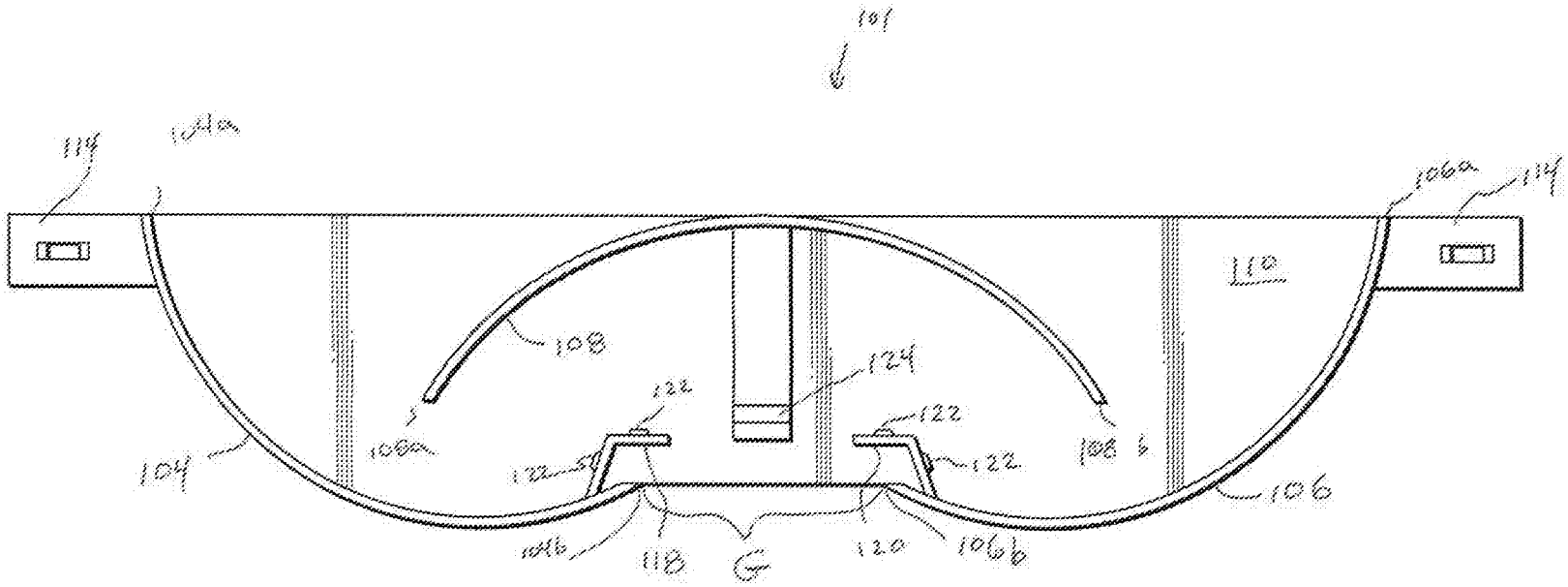
FIG. 4A is a cross-sectional view of the reflector system of FIG. 3C, taken through line 4A-4A.
Figure 4B:
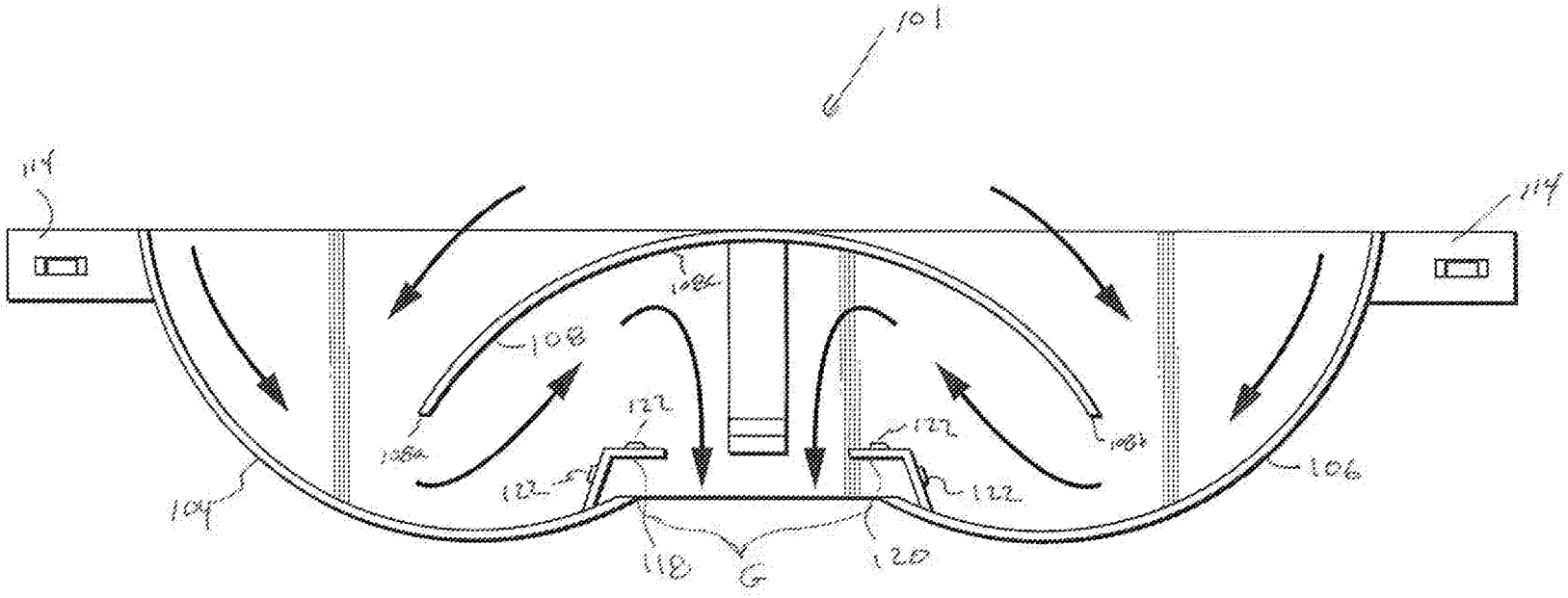
FIG. 4B is the cross-sectional view of FIG. 4A with arrows depicting possible fluid flow paths through the reflector system of FIG. 3C.

FIG. 4B depicts flow paths of ambient fluid being drawn through the reflector system 101 of the grill 100. Fluid is drawn over the secondary reflector 108 and inward at the primary reflector outer edges 104*a*, 106*a*, toward the intake gap G by passing between the secondary reflector outer edges 108*a*, 108*b* and the adjacent portions of the primary reflectors 104, 106. Fluid then flows along the intake side 108*c* of the secondary reflector and over the one or more light sources 122 before entering the intake gap G.

The air flow created by the reflector system 101 advantageously passes by the light sources 122 providing convective cooling for those light sources 122. Similarly, to the extent that the reflector system 101 absorbs heat from the light sources 122 or other heat sources, the air flow provides convective cooling to the entire reflector system 101 by directing air flow over the entire reflector system 101. The air flow over the secondary reflector 108 provides particular advantage in embodiments in which the secondary reflector 108 is configured to transmit some light from the light sources 122, which results in some absorption of heat from the transmitted light.

While preferred embodiments have been described above and illustrated in the accompanying drawings, it will be evident to those skilled in the art that modifications may be made without departing from this disclosure. Such modifications are considered as possible variants comprised in the scope of the disclosure.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. A ventilating and illumination system comprising:
- a main housing defining
  - a main housing internal volume,
  - a main housing inlet configured to receive air into the main housing, and
  - a main housing outlet configured to allow the air to exit the main housing;
- a reflector system comprising
  - a first primary reflector,
  - a second primary reflector configured and arranged to define an intake gap between the first primary reflector and the second primary reflector, and
  - a secondary reflector located over the intake gap;
- a light source configured and arranged to generate light wherein at least some of the light will be redirected by the reflector system; and
- a blower configured and arranged to generate a flow of air through the intake gap and into the main housing internal volume.

2. The ventilating and illumination system of claim 1, wherein the secondary reflector is configured and arranged to conceal the light source from a direct line of sight.

3. The ventilating and illumination system of claim 1, wherein the secondary reflector is configured and arranged to conceal the intake gap from a direct line of sight.

4. The ventilating and illumination system of claim 1, wherein air moved by the blower passes between the secondary reflector and at least one of the first and second primary reflectors before passing through the intake gap.

5. The ventilating and illumination system of claim 1, wherein air moved by the blower encounters the light source before passing through the intake gap.

6. The ventilating and illumination system of claim 1, the secondary reflector being curved convexly away from the main housing internal volume.

7. The ventilating and illumination system of claim 1, the first primary reflector being curved concavely toward the main housing internal volume.

8. The ventilating and illumination system of claim 1, the reflector system within the internal volume of the main housing.

9. The ventilating and illumination system of claim 1, the light source on the first and primary reflector.

10. The ventilating and illumination system of claim 1, wherein the reflector system further comprises a first end cap extending across a first end of the first and second primary reflectors and a second end cap extending across a second end of the first and second primary reflectors.

11. The ventilating and illumination system of claim 10, wherein the intake gap extends from the first end cap to the second end cap.

12. The ventilating and illumination system of claim 1, wherein the light source comprises a light emitting diode.

13. A grille assembly for a ventilation system, the grille assembly comprising:

a first primary reflector, a second primary reflector configured and arranged to define an intake gap between the first primary reflector and the second primary reflector, and a secondary reflector located over the intake gap;

a light source on one of the first and second primary reflectors and configured and arranged to generate light wherein at least some of the light will be redirected by both the primary and secondary reflectors.

14. The grille assembly claim 13, further comprising an end cap extending across a first end of the first and second primary reflectors.

15. The grille assembly of claim 13, the secondary reflector being translucent.

16. A grille assembly for a ventilation system, the grille assembly comprising:

a primary reflector defining an intake gap, and a secondary reflector located over the intake gap;

a light source on one of the first and second primary reflectors and configured and arranged to generate light wherein at least some of the light will be redirected by both the primary and secondary reflectors.

17. The grille assembly of claim 16 wherein the intake gap is generally circular.

18. A ventilating system comprising:

a main housing defining an inlet configured to receive air into the main housing and an outlet configured to allow the air to exit the main housing;

a blower in the main housing and configured and arranged to generate a flow of air through the main housing inlet and through the main housing outlet, the blower comprising:

a scroll defining a blower inlet configured to allow air to enter the scroll, and a blower outlet adjacent to the main housing outlet and configured to allow air to exit the scroll, a blower wheel in the scroll, wherein the blower outlet consumes only a portion of the area of the main housing outlet.

19. The ventilating system of claim 18, wherein the main housing outlet defines a height and the blower outlet defines a height less than the height of the main housing outlet.

20. The ventilating system of claim 19, wherein the main housing outlet defines a width and the blower outlet defines a width consuming the substantial entirety of the width of the main housing outlet.

* * * * *